US006278854B1

(12) United States Patent
Handa

(10) Patent No.: US 6,278,854 B1
(45) **Date of Patent: *Aug. 21, 2001**

(54) ELECTROPHOTOGRAPHIC APPARATUS AND PROCESS CARTRIDGE

(75) Inventor: Junichi Handa, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/050,469

(22) Filed: Mar. 31, 1998

(30) Foreign Application Priority Data

Mar. 31, 1997 (JP) ..... 9-079779

(51) Int. Cl.[7] ..... G03G 15/02

(52) U.S. Cl. ..... 399/111; 399/159; 399/174; 430/58.05

(58) Field of Search ..... 430/66, 67, 58.05, 430/59.6; 399/115, 116, 174, 159, 111

(56) References Cited

U.S. PATENT DOCUMENTS 4,515,882 * 5/1985 Mammino et al. ..... 430/66
5,008,706 * 4/1991 Ohmori et al. ..... 355/219
5,363,176 * 11/1994 Ishihara et al. ..... 355/219
5,491,539 * 2/1996 Shoji et al. ..... 399/115
5,830,614 * 11/1998 Pai et al. ..... 430/96
6,027,848 * 2/2000 Pai et al. ..... 430/58.05

* cited by examiner

*Primary Examiner*—Christopher Rodee
(74) *Attorney, Agent, or Firm*—Fitzpatrick, Cella, Harper & Scinto

(57) ABSTRACT

An electrophotographic apparatus is provided which has an electrophotographic photosensitive member, a charging member maintained in contact with the photosensitive member and charging the same by receiving a voltage, an exposure device, a developing device and a transfer device. The photosensitive member has a support, a charge generating layer on the support, and plural layers on the charge generating layer. The outermost surface layer of the plural layers has the largest relative dielectric constant. With the electrophotographic apparatus, good contrast between dark potential and light potential is maintained even after a prolonged use of the apparatus, and sufficient image density and image quality are obtained. Also a process cartridge adapted for use in the electrophotographic apparatus is provided.

4 Claims, 7 Drawing Sheets

ELECTROPHOTOGRAPHIC APPARATUS AND PROCESS CARTRIDGE

BACKGROUND OF THE INVENTION

1. Field of the Invention

The present invention relates to an electrophotographic apparatus in which contact charging is effected on an electrophotographic photosensitive member, and a process cartridge adapted for use in such apparatus.

2. Related Background Art

In the electrophotographic photosensitive member employed in the electrophotographic apparatus, inorganic photoconductive materials such as selenium, cadmium sulfide or zinc sulfide have principally been used as the photoconductive material, but organic photoconductive materials are widely used in recent years.

Organic dyes or pigments having a photoconductive property have the advantages of easier synthesis in comparison with the inorganic materials and freedom of selection of the compound showing photoconductivity in a suitable wavelength region.

The organic electrophotographic photosensitive members widely employed in the electrophotographic apparatus in recent years are of the function separation type in which the generation of charges and the transportation of charges are respectively conducted by different materials. The electrophotographic photosensitive members of such a function separated type can be divided into photosensitive members of a single-layer type in which a charge transporting material and a charge generating material are contained in the same layer, and photosensitive members of a laminated type including a charge generating layer containing the charge generating material and a charge transporting layer containing the charge transporting material, but the latter laminated type is commonly utilized. The electrophotographic photosensitive members of such laminated type are further divided into a type in which the charge generating layer is formed at the surface and a type in which the charge transporting layer is formed at the surface, but the latter structure is mainly utilized in order to protect the charge generating layer of a smaller thickness.

For the charging process in the electrophotographic apparatus employing such electrophotographic photosensitive member, the corona charging device has been widely employed. Such corona charging device, achieving charging by corona discharge in air, is very effective for uniformly charging the surface of the electrophotographic photosensitive member to a predetermined potential, but is also associated with certain drawbacks such as requiring a high-voltage power source and generating a large amount of ozone at the corona discharge.

In contrast, a contact charging device has the advantages that the power source can be of a lower voltage and that the generation of ozone is limited. The contact charging device charges the surface of the electrophotographic photosensitive member by applying a voltage to a charging member (such as a semi-conductive charging roller, a semi-conductive charging blade, a semi-conductive charging brush etc.) which is maintained in direct contact with the electrophotographic photosensitive member, and has recently been employed in place of the corona charging device, because of the above-mentioned advantages.

However, in an electrophotographic apparatus employing the laminated type electrophotographic photosensitive member having the charge transporting layer at the surface as in the prior art described above, the surface layer (charge transporting layer) of the photosensitive member is abraded and becomes thinner with the extended use of the electrophotographic apparatus, whereby the photosensitive member shows an increase in the electrical capacitance and a loss in the photosensitivity. As a result, the surface potential of the photosensitive member corresponding to a light area is not lowered sufficiently, whereby the potential contrast between the light potential and the dark potential becomes narrower. Therefore, for example in a normal developing system, if a sufficient developing contrast is desired in the image development, a sufficient inverse contrast cannot be given to the light potential, whereby the area corresponding to the light potential is developed with a low density to provide a so-called "fogged" image.

On the other hand, in the reversal developing system, the light potential is difficult to develop, whereby so-called a "low density" image is obtained.

The charging of the surface of the electrophotographic photosensitive member by the contact charging device gives rise to a significantly larger abrasion of the surface layer of the photosensitive member, in comparison with that provided by the corona charging device. Consequently the above-described "fogged" image appears earlier, and the service life of the electrophotographic photosensitive member or the electrophotographic apparatus employing such photosensitive member is shortened. Such a drawback becomes more conspicuous in case a pulsating voltage, obtained by superposing an AC voltage with a DC voltage, is applied to the charging means.

SUMMARY OF THE INVENTION

An object of the present invention is to provide an electrophotographic apparatus and a process cartridge, capable of maintaining the contrast between the dark potential and the light potential even after a prolonged use, thereby providing a sufficient image density and satisfactory image quality.

The above-mentioned object can be attained, according to the present invention, by an electrophotographic apparatus comprising an electrophotographic photosensitive member, a charging member maintained in contact with the electrophotographic photosensitive member and adapted to charge the same by receiving a voltage, an exposure means, a developing means and a transfer means, wherein the electrophotographic photosensitive member comprises a support member, a charge generating layer provided on the support member and plural layers provided on the charge generating layer; and the surface layer among the plural layers has the largest relative dielectric constant.

According to the present invention, there is also provided a process cartridge comprising an electrophotographic photosensitive member, and a charging member maintained in contact with the electrophotographic photosensitive member and adapted to charge the same by receiving a voltage, wherein the process cartridge integrally supports the electrophotographic photosensitive member and the charging member and is adapted to be detachably mounted in the main body of the electrophotographic apparatus;

the electrophotographic photosensitive member comprises a support member, a charge generating layer provided on the support member and plural layers provided on the charge generating layer; and the surface layer among the plural layers has the largest relative dielectric constant.

BRIEF DESCRIPTION OF THE DRAWINGS

FIGS. 9A, 9B and 9C are views showing examples of the charging member employable in the electrophotographic apparatus of the present invention, wherein FIG. 9A shows a semi-conductive blade in cross section, FIG. 9B shows a semi-conductive fur brush in cross section, and FIG. 9C shows a semi-conductive magnetic brush in cross section.

DETAILED DESCRIPTION OF THE PREFERRED EMBODIMENTS

The electrophotographic apparatus and the process cartridge of the present invention comprise an electrophotographic photosensitive member and a contact charging member, wherein the electrophotographic photosensitive member comprises a support member, a charge generating layer provided on the support member, and plural layers provided on the charge generating layer, and the surface layer among the above-mentioned plural layers has the largest relative dielectric constant.

At first the basic concept of the present invention will be explained, by an example of the laminated electrophotographic photosensitive member having two charge transporting layers.

Figure 1:
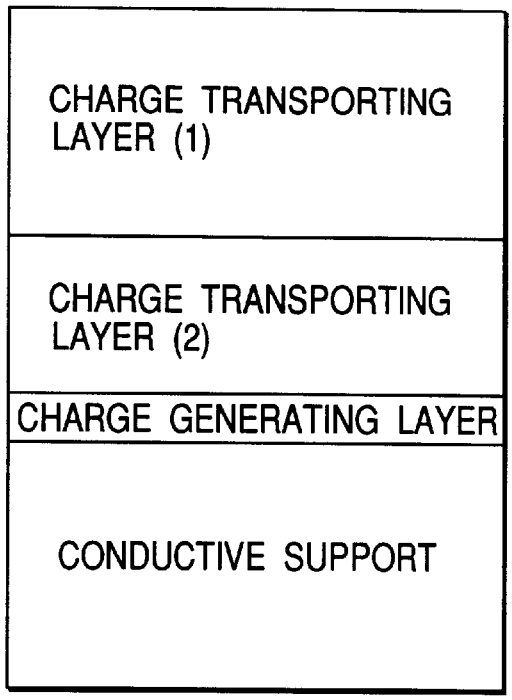
FIG. 1 is a cross-sectional view showing the layer configuration of an electrophotographic photosensitive member of the present invention having two charge transporting layers.

FIG. 1 is a schematic cross-sectional view showing the configuration of the laminated electrophotographic photosensitive member of the present invention.

Referring to FIG. 1, the laminated electrophotographic photosensitive member has, on a conductive support member, a charge generating layer, a charge transporting layer (2), and a charge transporting layer (1) laminated in succession, wherein the charge transporting layer (1) constitutes the outermost surface layer.

Since the charge generating layer is in general less than 1 $\mu$m in thickness and is considerably thinner than the charge transporting layer usually having a thickness of about 10 to 30 $\mu$m, the electrical capacitance C of the electrophotographic photosensitive member can be substantially represented by the synthesized capacitance of the charge transporting layers (1) and (2), as represented by the following equation (1):

$$C=(\epsilon_1\times\epsilon_2\times S)/(\epsilon_1\times d_2+\epsilon_2\times d_1) \quad (1)$$

wherein $\epsilon_1$: dielectric constant of charge transporting layer (1)

$\epsilon_2$: dielectric constant of charge transporting layer (2)

$d_1$: thickness of charge transporting layer (1)

$d_2$: thickness of charge transporting layer (2)

S: surface area of electrophotographic photosensitive member.

The photosensitivity of the electrophotographic photosensitive member becomes lower with the increase in the electric capacitance C thereof. Consequently, as the surface layer of the photosensitive member is abraded in the course of use of the electrophotographic apparatus, the electric capacitance C of the photosensitive member increases to decrease the photosensitivity. The object of the present invention, to suppress the decrease in the photosensitivity resulting from the abrasion of the surface layer of the photosensitive member, can be achieved by suppressing the increase in the electric capacitance C of the photosensitive member, resulting from the abrasion of the surface layer thereof. By differentiating both sides of the equation (1) with the thickness $d_1$ of the charge transporting layer (1) and taking the absolute values, there can be obtained the following equation (2):

$$|dC/dd_1|=\epsilon_1/(d_2\times\epsilon_1/\epsilon_2+d_1)^2 \quad (2).$$

By reducing the absolute value of the electric capacitance C of the photosensitive member differentiated by the thickness $d_1$ of the charge transporting layer (1), there can be suppressed the increase of the electric capacitance C of the photosensitive member resulting from the abrasion of the thickness $d_1$ of the charge transporting layer (1). The equation (2) indicates that, for a given thickness $d_1$ of the charge transporting layer (1), a given thickness $d_2$ of the charge transporting layer (2) and a given dielectric constant $\epsilon_1$ of the charge transporting layer (1), the change in the electric capacitance C of the photosensitive member can be reduced by a smaller value of $\epsilon_2$.

Figure 2:
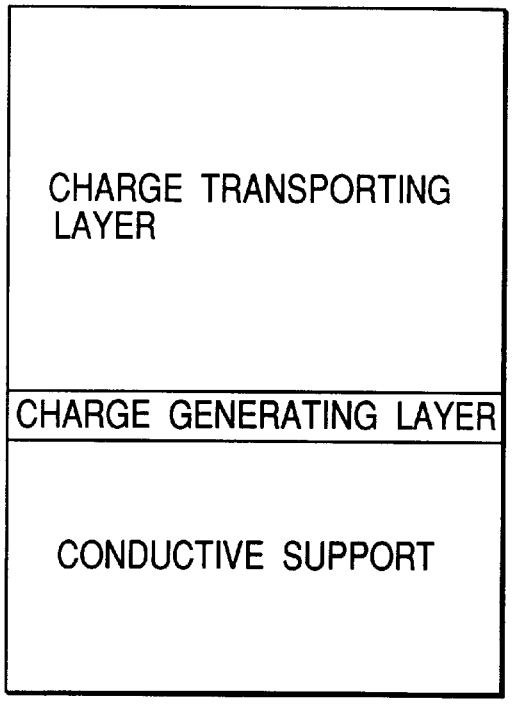
FIG. 2 is a cross-sectional view showing the layer configuration of a conventional electrophotographic photosensitive member having a charge transporting layer.

Therefore, in comparison with the conventional laminated electrophotographic photosensitive member with a single charge transporting layer (having a thickness d and a dielectric constant $\epsilon$) as shown in FIG. 2, a laminated electrophotographic photosensitive member with two charge transporting layers, having a total thickness d of the two charge transporting layers, a dielectric constant $\epsilon$ of the outermost surface charge transporting layer and a dielectric constant of the lower charge transporting layer smaller than $\epsilon$, can suppress the increase in the electric capacitance of the photosensitive member resulting from the abrasion of the charge transporting layer thereof, thereby suppressing the loss of the photosensitivity. The relative dielectric constant becomes naturally larger with an increase in the dielectric constant.

Figure 3:
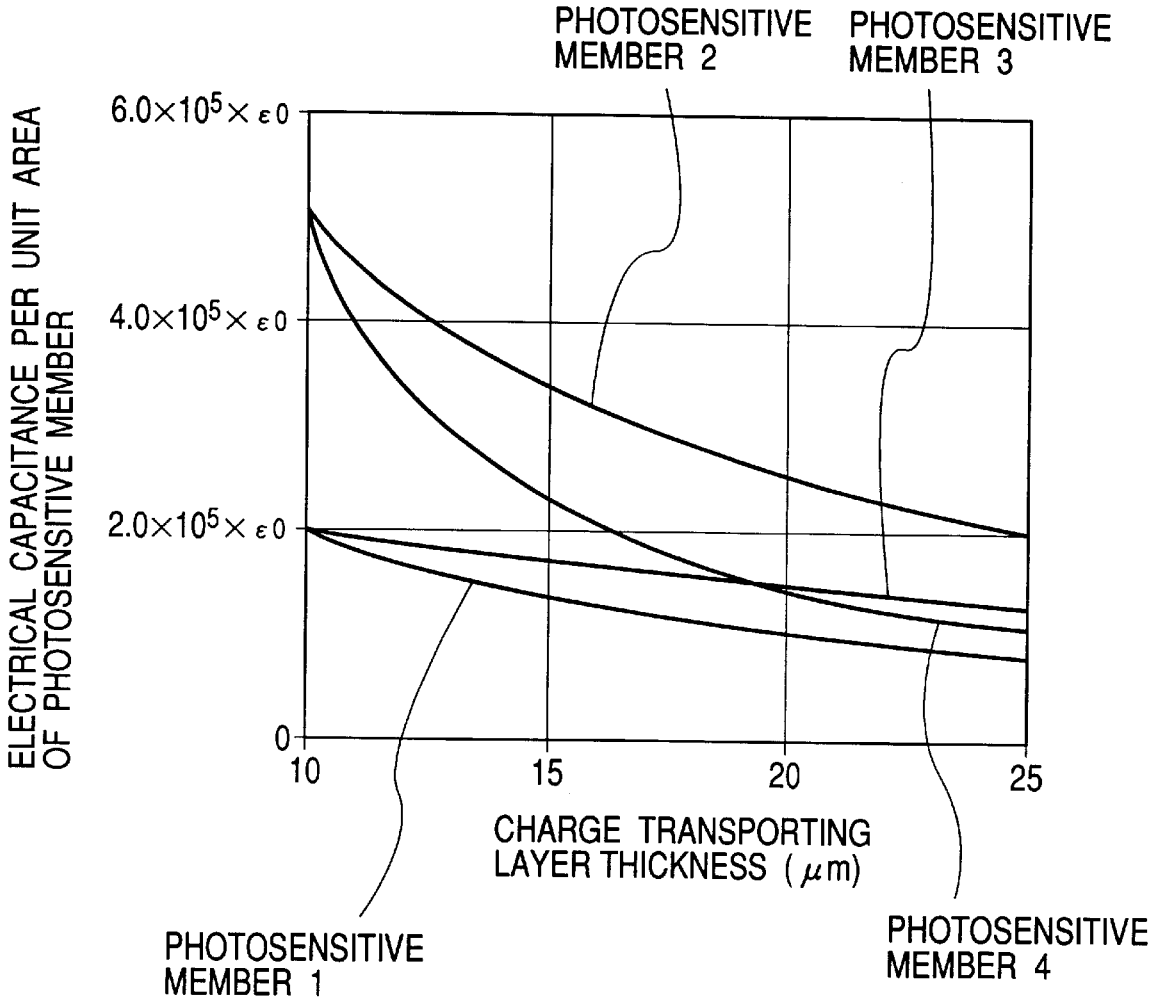
FIG. 3 is a graph showing the relationship between the thickness of the charge transporting layer and the electrical capacitance per unit area of the electrophotographic photosensitive member.

FIG. 3 shows, on the electrophotographic photosensitive members of the following four types, the change in the electric capacitance per unit area of the photosensitive member when the thickness of the charge transporting layer is abraded from 25 $\mu$m to 10 $\mu$m:

| | |
|---|---|
| photosensitive member 1: | $d_1 = 25\ \mu m$, $\epsilon_1 = 2 \times \epsilon_0$, $d_2 = 0$ |
| photosensitive member 2: | $d_1 = 25\ \mu m$, $\epsilon_1 = 5 \times \epsilon_0$, $d_2 = 0$ |
| photosensitive member 3: | $d_1 = 15\ \mu m$, $\epsilon_1 = 5 \times \epsilon_0$, $d_2 = 10\ \mu m$, $\epsilon_2 = 2 \times \epsilon_0$ |
| photosensitive member 4: | $d_1 = 15\ \mu m$, $\epsilon_1 = 2 \times \epsilon_0$, $d_2 = 10\ \mu m$, $\epsilon_2 = 5 \times \epsilon_0$ |

wherein $\epsilon_0$ is the dielectric constant of vacuum.

FIG. 3 indicates that the change in the electric capacitance per unit area of the photosensitive member, resulting from the abrasion of the charge transporting layer, is smallest in the photosensitive member 3 in which the charge transporting layer has a two-layered structure and $\epsilon_1 > \epsilon_2$.

In the foregoing the basic concept of the present invention has been explained with reference to a laminated electrophotographic photosensitive member in which the charge transporting layer has a two-layered structure, but, also in the laminated electrophotographic photosensitive member having three or more charge transporting layers, it is possible to reduce the change in the electric capacitance of the photosensitive member, resulting from the abrasion of the surface layer thereof, by making the dielectric constant of the outermost surface layer the largest among the dielectric constants of the layers constituting the charge transporting layer, namely by selecting the largest relative dielectric constant in such outermost surface layer, whereby the loss of the photosensitivity can be suppressed. The structure of the laminated electrophotographic photosensitive member having three or more charge transporting layers will not be explained further, as it is similar to what has been explained in the foregoing.

The outermost surface layer having the largest relative dielectric constant need not necessarily be a charge transporting layer. For example the outermost surface layer can be a resinous layer containing conductive particles or lubricant particles if necessary and an underlying layer can be a charge transporting layer having a relative dielectric constant smaller than that of the outermost surface layer.

Factors influencing the relative dielectric constant include the kind of the material employed, the amount of the charge transporting material and the conductivity of the layer. For example the relative dielectric constant tends to become larger with an increase in the proportion of the charge transporting material, and with an increase in the conductivity within a relatively low range of conductivity up to about $10^7$ Ωcm.

In the present invention, it is only required that the outermost surface layer, among the plural layers provided on the charge generating layer, has the largest relative dielectric constant, and the method for realizing such configuration is not particularly restricted.

Also in the present invention, the difference in the relative dielectric constant is preferably at least equal to 0.3. The advantageous effect of the present invention may not be fully obtained if the difference in the relative dielectric constant is less than 0.3.

In the following there will be explained embodiments of the present invention, with reference to the attached drawings.

Figure 4:
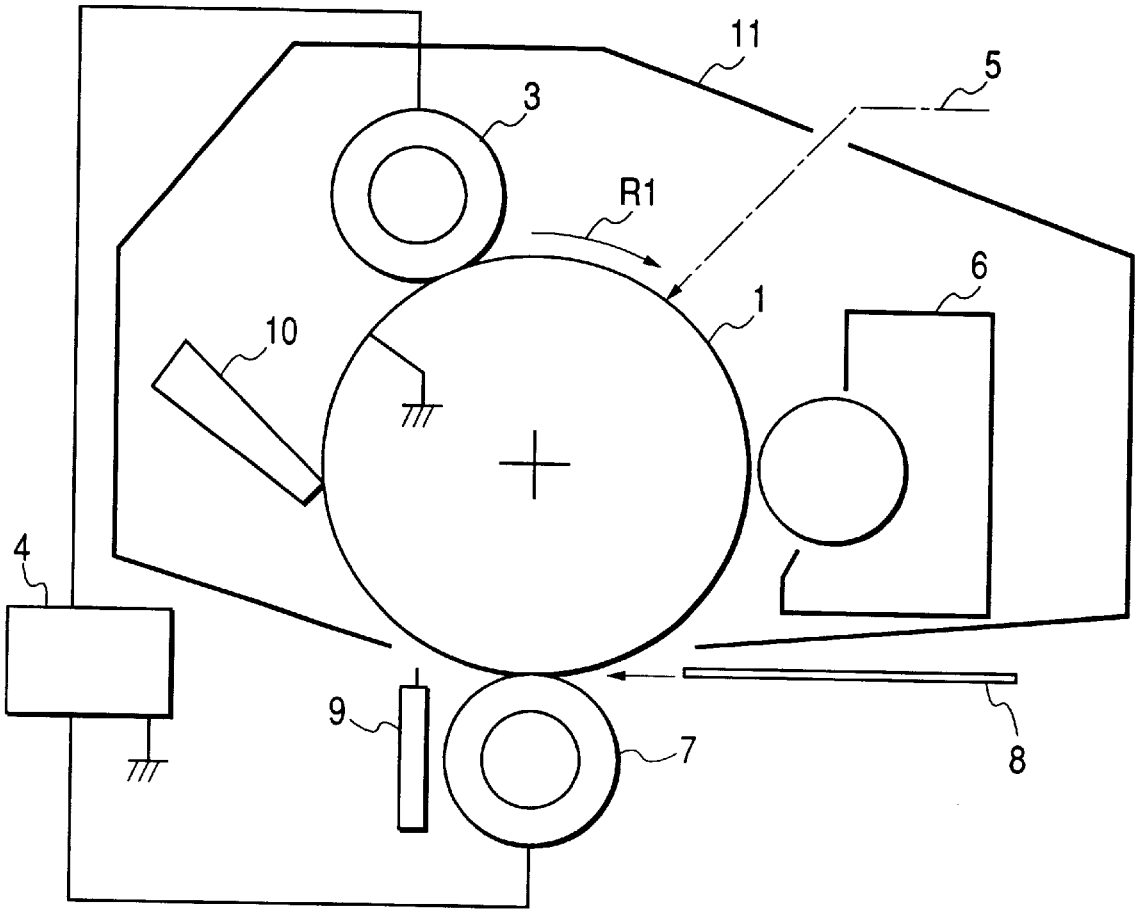
FIG. 4 is a schematic cross-sectional view showing the configuration of an electrophotographic apparatus constituting an embodiment of the present invention.

FIG. 4 is a schematic cross-sectional view showing the configuration of an electrophotographic apparatus of the present invention.

The electrophotographic apparatus shown in FIG. 1 is provided with an electrophotographic photosensitive member 1 (hereinafter referred to as photosensitive drum), rotated in a direction of arrow R1.

Figure 5:
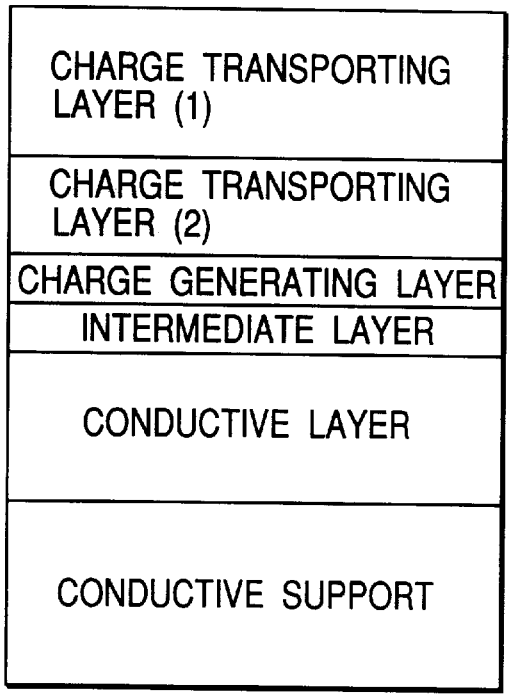
FIG. 5 is a cross-sectional view showing the layer configuration of a laminated electrophotographic photosensitive member employed in the electrophotographic apparatus shown in FIG. 4.

FIG. 5 schematically shows the layered configuration of the photosensitive drum 1. As shown in FIG. 5, on the photosensitive drum 1 is provided, the external periphery of an aluminum cylinder constituting a conductive support member, a conductive layer of a thickness of 15 μm for covering the scars, etc., of the cylinder, an intermediate layer of a thickness of 0.5 μm for improving the barrier property and the adhesion, a charge generating layer of a thickness of 0.3 μm, a charge transporting layer (2) having a relative dielectric constant of 2 and a thickness of 10 μm, and a charge transporting layer (1) constituting the outermost surface layer and having a relative dielectric constant of 5 and a thickness of 15 μm, in this order.

The charge transporting layer (2) was formed using 10 parts (parts by weight; the same applies hereinafter) of a polypropylene resin, 7 parts of a triarylamine compound represented by the following formula (3):

(3)

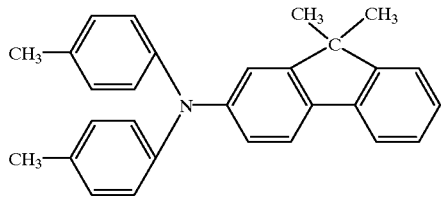

and 3 parts of a styryl compound represented by the following formula (4):

(4)

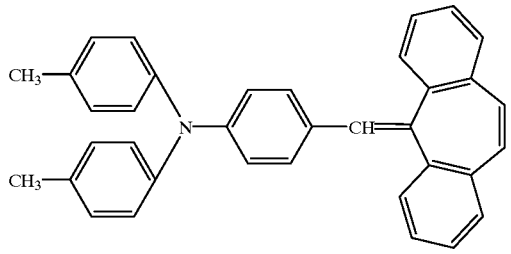

The charge transporting layer (1) was formed using 10 parts of a polyester resin, 7 parts of a triarylamine compound represented by the foregoing formula (3) and 3 parts of a styryl compound represented by the foregoing formula (4).

The relative dielectric constant was measured by an impedance measuring instrument (YHP4192A manufactured by Yokogawa Hewlett Packard Co.), at a frequency of 1 kHz.

Along the periphery of the photosensitive drum 1, there are provided, in succession along the rotating direction thereof, a charging roller 3 as a contact charging member for uniformly charging the surface of the photosensitive drum 1 at a predetermined potential, an exposure means 5 for forming an electrostatic latent image on the photosensitive drum 1 according to image information, a developing means 6 for forming a toner image by depositing toner onto the electrostatic latent image, transfer means 7 for transferring the toner image from the photosensitive drum 1 onto a transfer material (recording material) 8, a charge eliminating device 9 for eliminating charges of the recording material 8 after the toner image transfer, and a cleaner 10 for removing the toner remaining on the surface of the photosensitive drum 1 after the toner image transfer. A power source 4 supplies the charging roller 3 with a voltage obtained by superposing a DC voltage with an AC voltage. In the present invention, the photosensitive drum 1 and the charging member, together with the developing means 6 and the cleaner 10 if necessary, may be integrally supported as a process cartridge 11, which is detachably mounted in the main body of the electrophotographic apparatus.

In the electrophotographic apparatus of the above-described configuration, the image forming operation is conducted in the following manner.

The photosensitive drum 1 is rotated in a direction R1, at a predetermined peripheral speed of 90 mm/sec. The charging roller 3 receives, from the power source 4, a superposed voltage consisting of an AC voltage (sinusoidal voltage of a constant current of 850 $\mu$A and a frequency of 720 Hz) and a DC voltage (constant voltage of −710 V) to uniformly charge the surface of the photosensitive drum 1 at a potential of −680 V. The surface potential −680 V of the photosensitive drum 1, obtained by charging with the charging roller 3, is called the dark potential. The photosensitive drum 1 after charging is subjected to exposure of the desired image information by the exposure means 5 (a slit exposure of the original image or a scanned exposure to a laser beam; the present embodiment employing a slit exposure of the original image) to form an electrostatic latent image.

The amount of light from the exposure means 5 is so controlled that the exposure amount to the photosensitive drum surface corresponding to a white original of a reflective density of 0.06 is 0.9 lux.sec. The surface potential of the photosensitive drum 1, after receiving an exposure amount of 0.9 lux.sec corresponding to the white original of the reflective density of 0.06, will hereinafter be called the light potential. In the initial stage of use of the photosensitive drum 1, when the total thickness of the charge transporting layers is 25 $\mu$m, the light potential is −150 V. The latent image is then rendered visible by the developing means 6. The visible toner image formed on the photosensitive drum 1 is transferred by the transfer means 7 onto the recording material 8, then the charge eliminating device 9 eliminates the charges of the recording material 8 after the image transfer, and the recording material 8 is transported to unshown fixing means for fixing the toner image on the recording material 8.

On the other hand, the photosensitive drum 1 after the image transfer is subjected to the removal of the developer remaining on the surface thereof by the cleaner 10, and is thus prepared for the next image formation.

In the electrophotographic apparatus of the present embodiment, the change in the light potential was measured by a durability test by forming A4-sized images. For the purpose of comparison, the change in the light potential was measured in a similar durability test employing a conventional photosensitive drum 2 with a single charge transporting layer, instead of the photosensitive drum 1, as the photosensitive member of the electrophotographic apparatus. The layered configuration of the conventional photosensitive drum 2 is schematically shown in FIG. 6.

Figure 6:
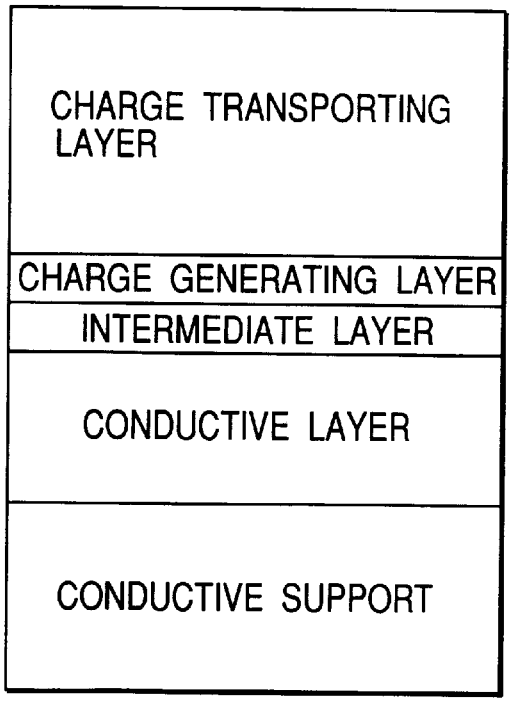
FIG. 6 is a cross-sectional view showing the layer configuration of a conventional electrophotographic photosensitive member.

As shown in FIG. 6, on the photosensitive drum 2 is provided, the external periphery of an aluminum cylinder, a conductive layer of a thickness of 15 $\mu$m, an intermediate layer of a thickness of 0.5 $\mu$m, a charge generating layer of a thickness of 0.3 $\mu$m, and a charge transporting layer constituting the outermost surface layer and having a relative dielectric constant of 5 and a thickness of 25 $\mu$m. The material used for forming the charge transporting layer is the same as that for the charge transporting layer (1) of the photosensitive drum 1. The amount of light from the exposure means 5 to the photosensitive drum 2 is so controlled that the exposure amount to the photosensitive drum surface corresponding to a white original of a reflective density of 0.06 is 1.44 lux.sec, and, in the initial stage of use of the photosensitive drum 2, when the thickness of the charge transporting layers is 25 $\mu$m, the light potential is −150 V.

Figure 7:
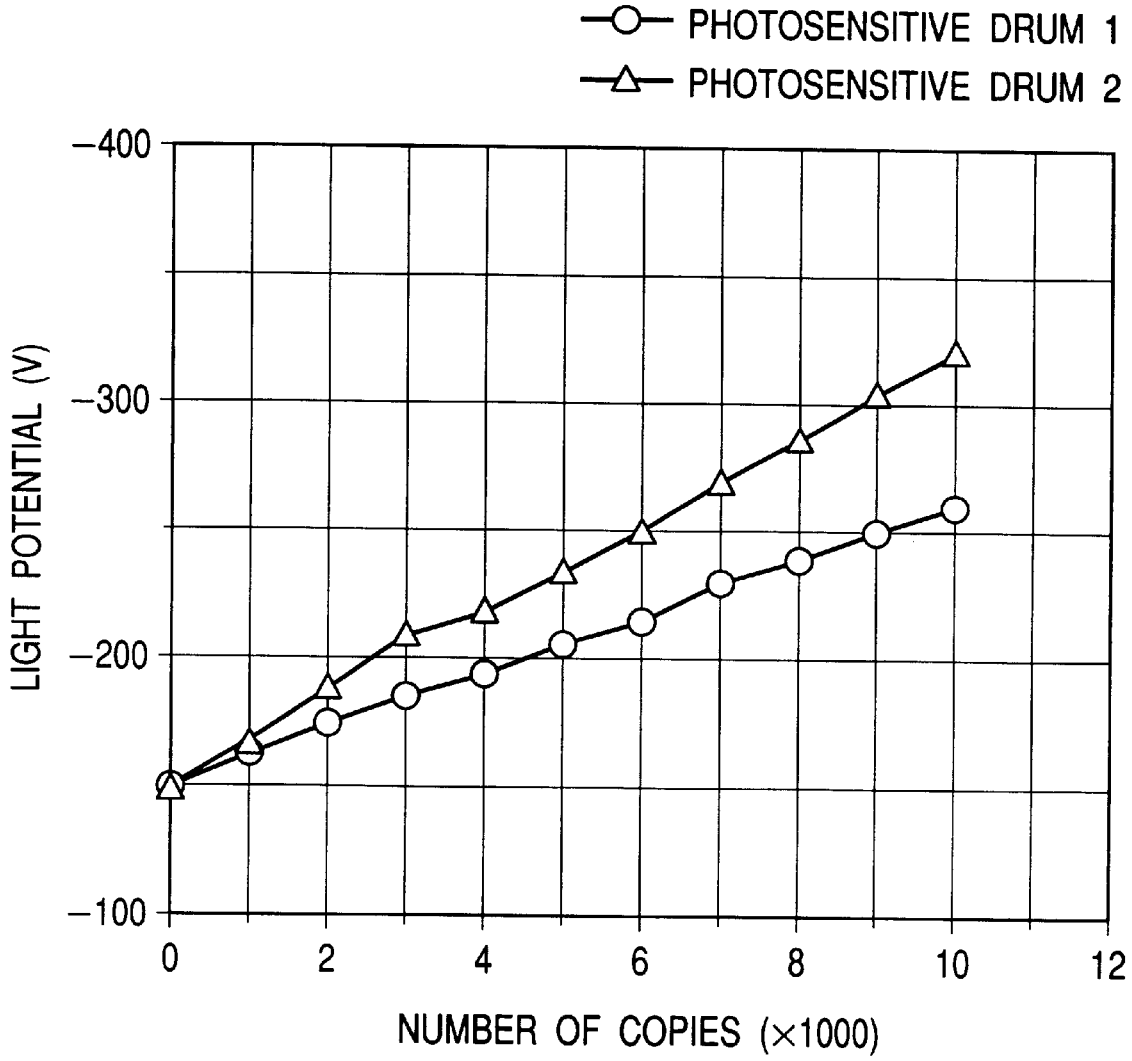
FIGS. 7 and 8 are graphs showing the change in the light potential along the use of the electrophotographic apparatus.

FIG. 7 shows the results of measurement of the light potential in the course of the durability test of the electrophotographic apparatus of the present embodiment.

In FIG. 7, marks ○ indicate the measured light potentials obtained with the photosensitive drum 1, while marks Δ indicate those obtained with the photosensitive drum 2. From FIG. 7, it will be understood that the light potential becomes higher with the progress of the durability test, because the surface layer of the photosensitive drum is abraded to increase the electric capacitance of the photosensitive member, thereby lowering the photosensitivity thereof.

In the durability test of the present embodiment, the amount of abrasion of the surface layer was substantially the same in the photosensitive drum 1 and the photosensitive drum 2 and was about 1 $\mu$m per 1,000 image forming cycles. Both the photosensitive drums 1 and 2 generated the aforementioned "fogged" image when the light potential reaches about −250 V, but, while the conventional photosensitive drum 2 started to show the "fogged" image after about 6,000 image forming cycles (when the thickness of the charge transporting layer was about 19 $\mu$m), the photosensitive drum 1 of the present invention showed such "fogged" image only after about 9,000 image forming cycles (when the total thickness of the charge transporting layers was about 16 $\mu$m).

As explained in the foregoing, by forming the charge transporting layer of the photosensitive drum having the charge transporting layer as the surface layer into a layer with a two-layered structure and making the dielectric constant of the lower layer of the charge transporting layer smaller than that of the outermost surface layer, it is rendered possible to suppress the increase in the electric capacitance of the photosensitive member, resulting from the abrasion of the surface layer of the photosensitive drum, thereby suppressing the loss in the photosensitivity of the photosensitive drum. As a result the generation of the "fogged" image can be delayed and the service life of the photosensitive drum can be extended by about 1.5 times.

Another photosensitive drum 3 was prepared in the same manner as the preparation of the photosensitive drum 1 except that a polystyrene resin was substituted for the polypropylene resin to form a charge transporting layer (2) having a thickness of 15 $\mu$m, and a polycarbonate resin was used in place of the polyester resin to form a charge transporting layer (1) having a thickness of 10 $\mu$m. The charge transporting layer (2) had a relative dielectric constant of 2.5, and the charge transporting layer (1) had a relative dielectric constant of 3.4.

Also a durability test was conducted in the same manner as explained in the foregoing, except that the photosensitive drum 3 thus obtained was used and the exposure amount to the photosensitive drum was controlled to 0.84 lux.sec.

Furthermore a durability test was conducted in the same manner as explained in the foregoing, except that there was employed a photosensitive drum 4 having a single charge transporting layer of a thickness of 25 $\mu$m and composed of the material same as that of the charge transporting layer (1) and the exposure amount to the photosensitive drum was selected as 1.02 lux.sec.

Figure 8:
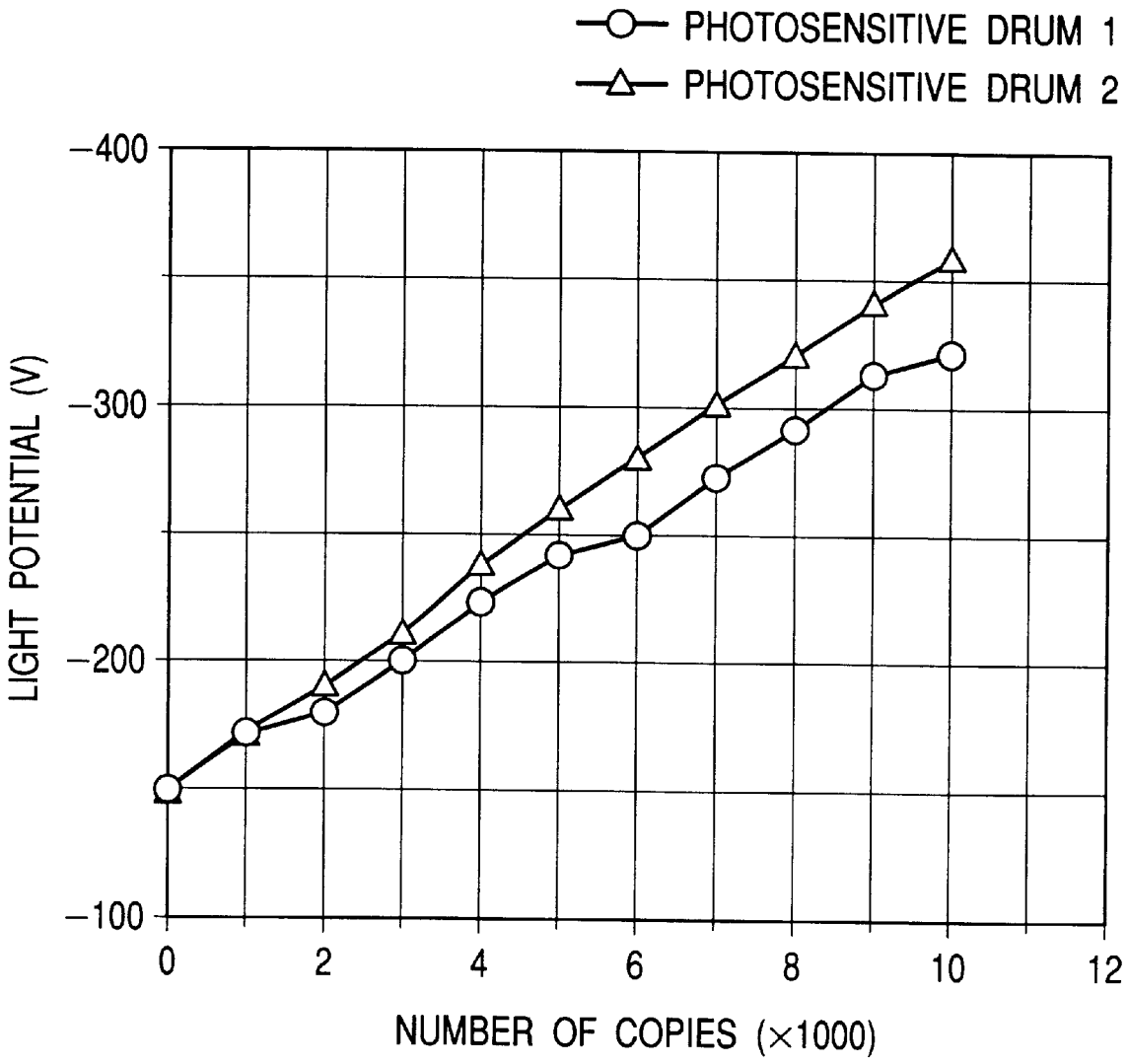

FIG. 8 shows the results of measurement of the light potential in the course of the durability test of the electrophotographic apparatus of the present embodiment.

In FIG. 8, marks ○ indicate the measured light potentials obtained with the photosensitive drum 3, while marks Δ indicate those obtained with the photosensitive drum 4. From FIG. 8, it will be understood that the light potential becomes higher with the progress of the durability test, because the surface layer of the photosensitive drum is abraded to increase the electric capacitance of the photosensitive member, thereby lowering the photosensitivity thereof.

In the durability test of the present embodiment, the amount of abrasion of the surface layer was substantially the same both in the photosensitive drum 3 and the photosensitive drum 4 and was about 1 μm per 1,000 image forming cycles. Both the photosensitive drums 3 and 4 generated the aforementioned "fogged" image when the light potential reaches about −250 V, but, while the conventional photosensitive drum 4 started to show the "fogged" image after about 4,700 image forming cycles (when the thickness of the charge transporting layer was about 20.3 μm), the photosensitive drum 3 of the present invention showed such "fogged" image only after about 5,800 image forming cycles (when the total thickness of the charge transporting layers was about 19.2 μm).

As explained in the foregoing, by forming the charge transporting layer of the photosensitive drum having the charge transporting layer as the surface layer into a layer with a two-layered structure and making the dielectric constant of the lower layer of the charge transporting layer smaller than that of the outermost surface layer, it is rendered possible to suppress the increase in the electric capacitance of the photosensitive member, resulting from the abrasion of the surface layer of the photosensitive drum, thereby suppressing the loss in the photosensitivity of the photosensitive drum. As a result the generation of the "fogged" image can be delayed and the service life of the photosensitive drum can be extended by about 1.2 times.

The foregoing embodiments employ an electrophotographic photosensitive member having two charge transporting layers, but similar effects can also be obtained with an electrophotographic photosensitive member having three or more charge transporting layers as well as with an electrophotographic photosensitive member of which the outermost surface layer is not a charge transporting layer, as long as the outermost surface layer of the plural layers has the largest dielectric constant, preferably different at least by 0.3 from that of the underlying layer.

Also the foregoing embodiments employ a cylindrical photosensitive drum as the electrophotographic photosensitive member, but the present invention is applicable regardless of the shape of the electrophotographic photosensitive member.

Figure 9A:
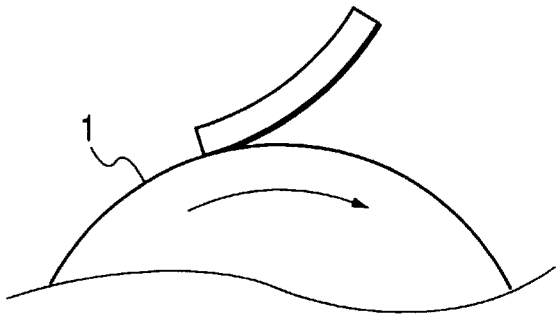
Figure 9B:
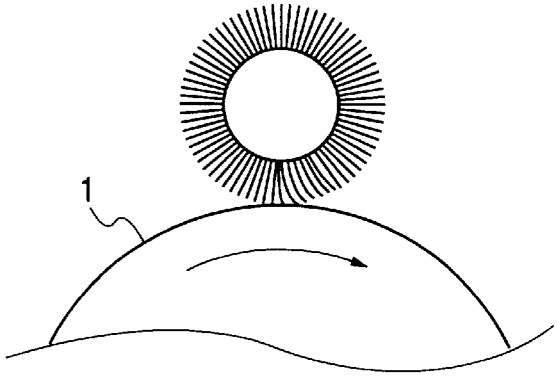
Figure 9C:
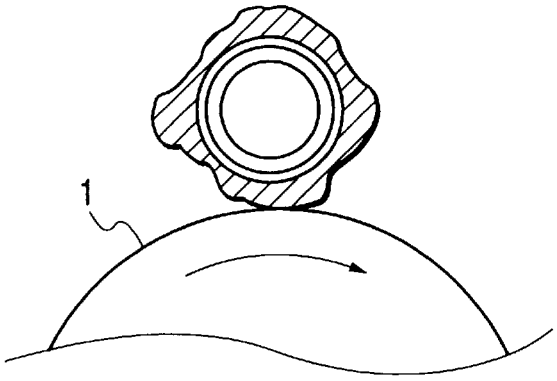

Also the foregoing embodiments have been explained by a configuration employing a charging roller as the charging member, but the present invention is likewise applicable to configurations employing a semi-conductive blade, a semi-conductive fur brush or a semi-conductive magnetic brush shown respectively in FIGS. 9A, 9B or 9C.

Also the exposure means, the developing means and the transfer means are not limited to those shown in the foregoing embodiments.

What is claimed is:

1. An electrophotographic apparatus comprising:

an electrophotographic photosensitive member;

a charging member maintained in contact with said electrophotographic photosensitive member and adapted to charge said electrophotographic photosensitive member by receiving a voltage;

exposure means for forming a latent image on said electrophotographic photosensitive member;

developing means for forming a toner image by depositing toner onto the latent image formed on said electrophotographic photosensitive member; and transfer means for transferring the toner image from said electrophotographic photosensitive member to a transfer material, wherein said electrophotographic photosensitive member comprises a support member, a charge generating layer provided on said support member, and plural layers provided on said charge generating layer;

wherein the outermost surface layer among said plural layers has the largest relative dielectric constant, wherein all of said plural layers are charge transporting layers, wherein the outermost surface layer is capable of holding thereon charges which are imparted by said charging member, and wherein, among said plural layers, the relative dielectric constant of the outermost surface layer and an underlying layer differ by at least 0.3.

2. An electrophotographic apparatus according to claim 1, wherein the voltage applied to said charging member is a pulsating voltage obtained by superposing a DC voltage with an AC voltage.

3. A process cartridge comprising:

an electrophotographic photosensitive member; and a charging member maintained in contact with said electrophotographic photosensitive member and adapted to charge said electrophotographic photosensitive member by receiving a voltage, wherein said process cartridge integrally supports said electrophotographic photosensitive member and said charging member, and is detachably mountable in the main body of an electrophotographic apparatus;

wherein said electrophotographic photosensitive member comprises a support member, a charge generating layer provided on said support member, and plural layers provided on said charge generating layer;

wherein the outermost surface layer among said plural layers has the largest relative dielectric constant, wherein all of said plural layers are charge transporting layers, wherein the outermost surface layer is capable of holding thereon charges which are imparted by said charging member, and wherein, among said plural layers, the relative dielectric constant of the outermost surface layer and an underlying layer differ by at least 0.3.

4. A process cartridge according to claim 3, wherein the voltage applied to said charging member is a pulsating voltage obtained by superposing a DC voltage with an AC voltage.

* * * * *

UNITED STATES PATENT AND TRADEMARK OFFICE

CERTIFICATE OF CORRECTION

PATENT NO. : 6,278,854 B1
DATED : August 21, 2001
INVENTOR(S) : Junichi Handa

It is certified that error appears in the above-identified patent and that said Letters Patent is hereby corrected as shown below:

Column 2,
Line 22, “Consequently” should read -- Consequently, --.

Column 5,
Line 37, “example” should read -- example, --.
Line 45, “example” should read -- example, --.

Column 8,
Line 44, “result” should read -- result, --.
Line 61, “Furthermore” should read -- Furthermore, --.

Column 9,
Line 39, “result” should read -- result, --.

Signed and Sealed this

Twenty-third Day of July, 2002

*Attest:*

*Attesting Officer*

JAMES E. ROGAN
*Director of the United States Patent and Trademark Office*